United States Patent [19]

Tsuji et al.

[11] 4,314,774

[45] Feb. 9, 1982

[54] PNEUMATICALLY INFLATABLE FLEXIBLE ENVELOPE TYPE DAM

[75] Inventors: Yoshiomi Tsuji; Akio Matsuda; Tamaki Ikeda; Kenji Mori, all of Osaka, Japan

[73] Assignee: Sumitomo Electric Industries, Ltd., Osaka, Japan

[21] Appl. No.: 88,915

[22] Filed: Oct. 29, 1979

[30] Foreign Application Priority Data

Oct. 31, 1978 [JP] Japan ..... 53-134756

[51] Int. Cl.[3] ..... E02B 7/02

[52] U.S. Cl. ..... 405/115; 405/91

[58] Field of Search ..... 405/115, 91, 87–90, 405/107

[56] References Cited

U.S. PATENT DOCUMENTS

| | | | |
|---|---|---|---|
| 495,788 | 4/1893 | Debarle | 405/115 |
| 2,609,666 | 9/1952 | Mesnager | 405/115 |
| 3,173,269 | 3/1965 | Imbertson | 405/115 X |

FOREIGN PATENT DOCUMENTS

| | | | |
|---|---|---|---|
| 649778 | 5/1979 | U.S.S.R. | 405/115 |

*Primary Examiner*—Dennis L. Taylor

*Attorney, Agent, or Firm*—Sughrue, Mion, Zinn, Macpeak and Seas

[57] ABSTRACT

An inflatable flexible envelope type dam including members having large specific gravity attached to said envelope. The members allow said envelope to fall down in its deflating state by overcoming buoyancies given by residual fluid in said envelope.

13 Claims, 9 Drawing Figures

PNEUMATICALLY INFLATABLE FLEXIBLE ENVELOPE TYPE DAM

BACKGROUND OF THE INVENTION

This invention relates to a pneumatically inflatable flexible envelope type dam secured to a river bed, and more particularly, to a type thereof having means for preventing the flexible envelope from floating in the water stream during its deflated state.

One of the examples of the conventional inflatable envelope type dam is disclosed in Japanese patent publication Nos. 11702/65 and 2371/69 as shown in FIGS. 1(*a*) and 1(*b*), wherein a flexible envelope 1 made of rubberized fabric is inflated with fluid 3 such as air causing the envelope to stand up in a river bed 2 to thus provide a dam. Reference numeral 4 designates the upstream side of the dam.

The dam of this type may have a drawback when water stays at the downstream side of the dam during the deflating state thereof. That is, as shown in FIG. 1(*b*), residual fluid 3 may remain in the envelope 1 after discharge of the fluid from the envelope 1, so that the dam can not be completely fallen down along the river bed 2 due to the buoyancy given by the residual fluid 3. To be more specific, the residual fluid 3 does exist, since the envelope 1 cannot be completely folded to provide perfect contact between opposing inner surfaces of the envelope due to rigidity of the rubberized fabric. The rigidity provides cylindrical space at the portion to be folded along the transverse direction of the river. The cylindrical space provides an air pillow whose buoyancy is generally larger than the weight of the envelope 1.

Due to this phenomena, it is difficult to convey earth and sand accumulated at the upstream side of the dam far behind the downstream side of the dam when the dam is deflated. Further, earth and sand accumulated at the immediate downstream side of the dam by the deflation cannot be conveyed far behind the dam. Furthermore, there will be a strong probability that the floatingly deflated envelope is damaged or broken by trees etc. which flow down along the river stream. In addition to the above, the deflated envelope may be visually unappealing.

Another example of the conventional inflatable envelope type dam is shown in FIGS. 2(*a*) and 2(*b*), wherein buffer members are attached to at least a portion of the inner surface of the envelope and a portion of the dam base in order to protect the envelope from trees or rolling stones etc during the deflating state thereof. In these drawings, a plurality of pockets 5 are attached to a portion of the inner surface of the envelope 1 along the transverse direction of the river in parallel. These pockets 5 are formed of plastic sheet material, cloth or rubberized fabric. A buffer member 6 is disposed in each pocket 5. The buffer members 6 are made of any material capable of providing a shock absorbing effect such as foam material having flexibility. Specifically, PE-foaming material provides excellent shock absorbing effect because of its lightness, high flexibility and durability.

The shock absorbing mats 6 are spread at the position between an imaginary folded line "a" of the envelope 1 and anchors 7 fixed to a foundation member 2 for securing the envelope 1. These mats 6 have a predetermined width and are equally spaced along the inner circumference of the envelope in order to follow up the curvature of the envelope. The width of the shock absorbing mat is determined in light of the flexibility and followability thereof with respect to the movement of the envelope, while the distance between the neighboring mats is determined so that the mats do not interfere with the other during inflation of each envelope.

Further, the shock absorbing mats are disposed in series with a predetermined transverse space "d" along the transverse direction of the river. The length of the mat is determined in light of productivity and installability. The length and space are also determined so as to prevent the dam from generating V-notch (buckling) phenomena during the deflating process in case of the employment of air as the inflating media, which may damage the shock absorbing mats 6.

A dam base 10 is provided with a flexible membrane 11 independent of the envelope 1. The flexible membrane 11 is provided with a pocket 5' into which a shock absorbing mat 6' is disposed. It goes without saying that the manner for providing the buffer members or the positional arrangement thereof is not limited to that disclosed the above.

With this structure, when the flow rate of water is relatively high, the dam can be fallen down substantially completely in its deflating state. However, when the flow rate is relatively low, the portion of the envelope to be folded may float up due to the buoyancy of the buffer members and the residual air. That is, the weight of the dam does not overcome these buoyancies.

SUMMARY OF THE INVENTION

It is therefore an object of the present invention to overcome the above mentioned deficiencies, and to provide an improved inflatable envelope type dam capable of preventing floating during its deflated state.

These objects are attained in accordance with the present invention by providing special members attached to at least a portion of the inner surface of the envelope. The special members have high specific gravity so as to permit the dam to completely fall down into the water during deflating.

These and other objects of this invention will become apparent from the description of the drawings and the preferred embodiments which follow.

DETAILED DESCRIPTION OF THE PRESENT INVENTION

According to the present invention, a block or sheet-like member having large specific gravity is attached to an inner or outer surface of an envelope 1 in order to obtain total weight of a dam larger than the buoyancy thereof during its deflated state. Such materials are, for example, rubber having large specific gravity, or lead.

Figure 1A:
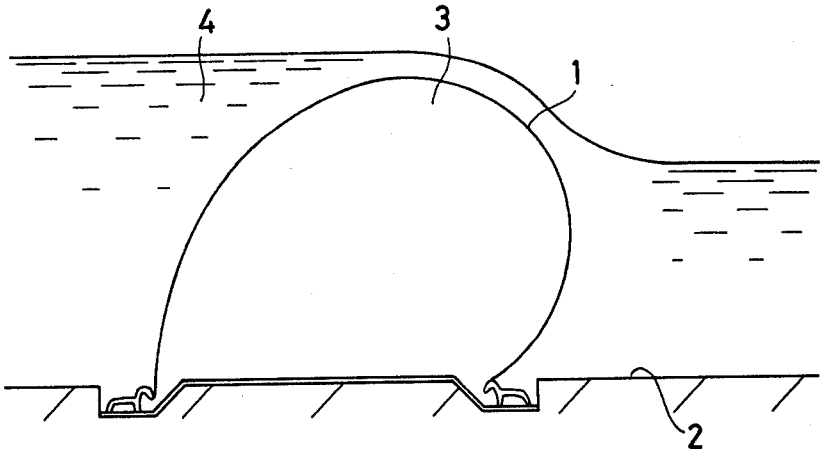
FIGS. 1(*a*) and 1(*b*) are transverse cross-sectional views of one of the conventional flexible envelope type dams in its inflating and deflating states, respectively.
Figure 1B:
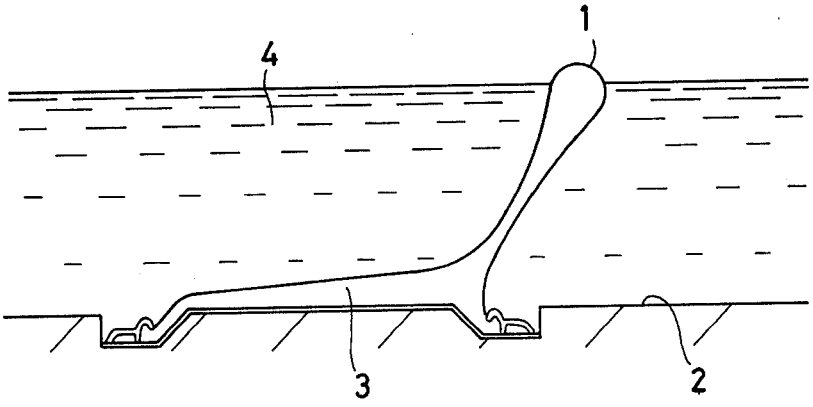
Figure 2A:
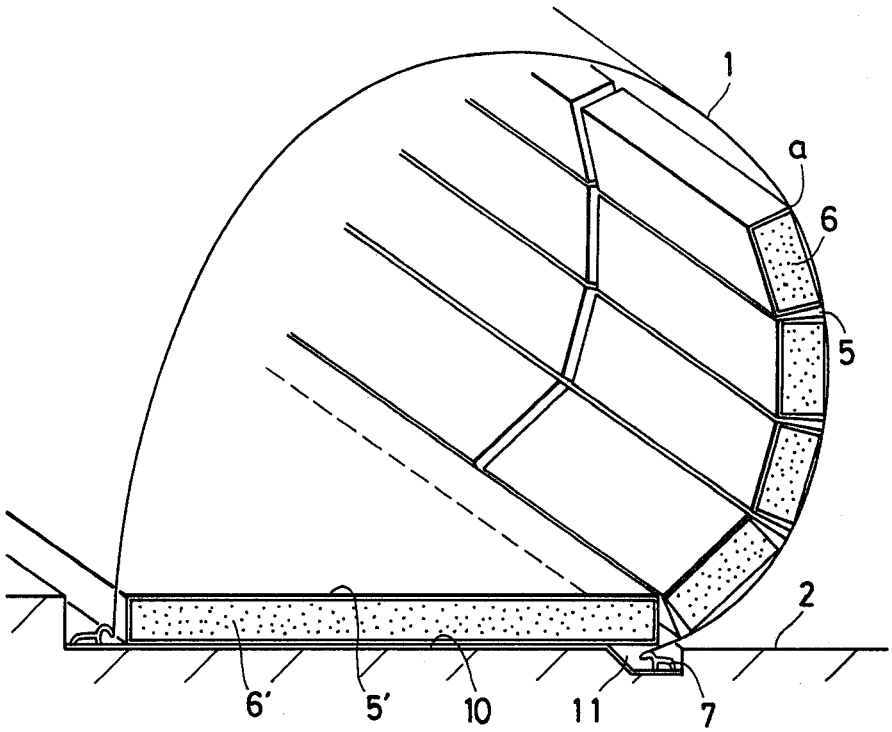
FIGS. 2(*a*) and 2(*b*) are schematic illustrations of another example of the conventional flexible envelope type dam in its inflating and deflating states, respectively.
Figure 2B:
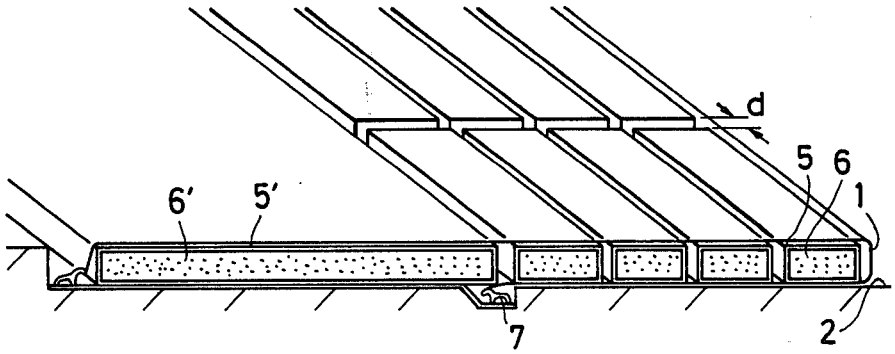
Figure 3:
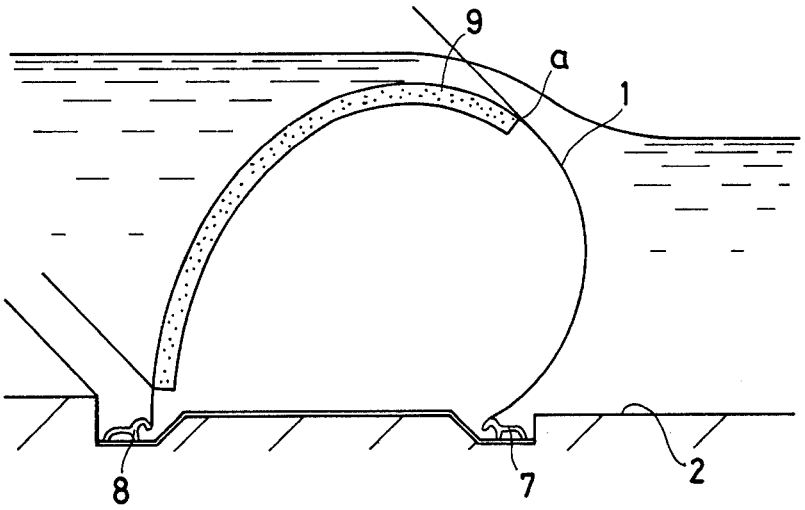
FIG. 3 is a schematic illustration of a flexible envelope type dam according to a first embodiment of the present invention.
Figure 4:
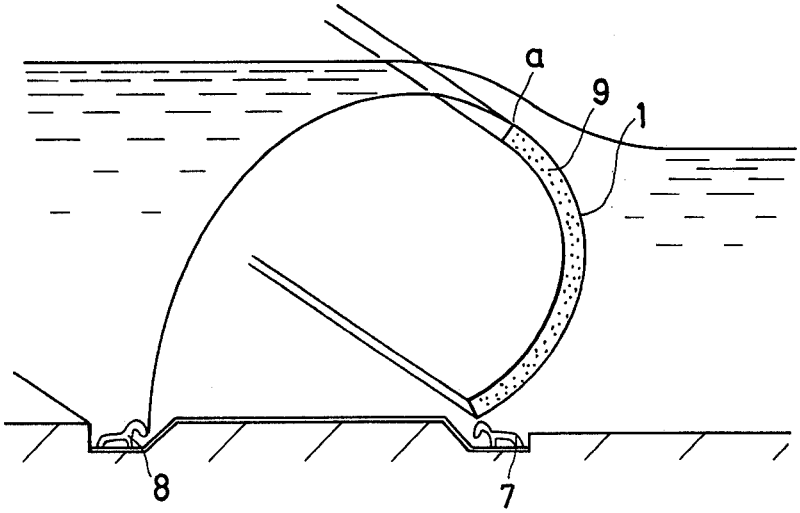
FIG. 4 is a schematic illustration of a flexible envelope type dam according to a second embodiment of the present invention.

A first embodiment according to this invention is shown in FIG. 3, wherein an attaching member 9 provides high flexibility, such as rubber having large specific gravity. In this case, the attaching member 9 is attached to an inner peripheral surface of the envelope 1 at a position spreading between an imaginary folded line "a" and an anchor 8 of the upstream side of the dam for securing the envelope to a foundation member 2. In the second embodiment, shown in FIG. 4, the attaching member is spread between the imaginary folded line "a" and an anchor 7 of the downstream side of the dam for securing the envelope to the foundation member 2. The attaching member can also be attached so as to spread along the whole surface of the envelope between the anchors 7 and 8.

Figure 5A:
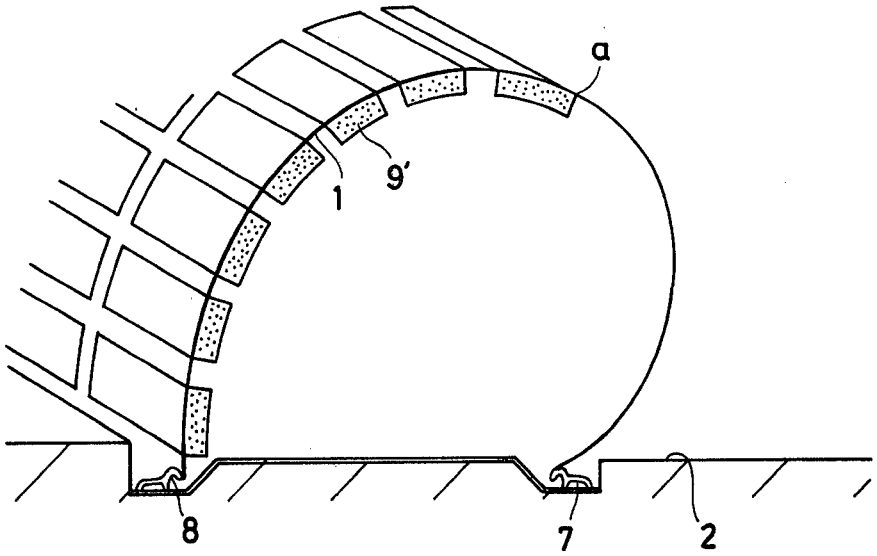
FIGS. 5(*a*) and 5(*b*) show schematic illustrations of a third embodiment of this invention in its inflating and deflating states, respectively; and, FIG. 6 shows a schematic view of a fourth embodiment according to this invention.
Figure 5B:
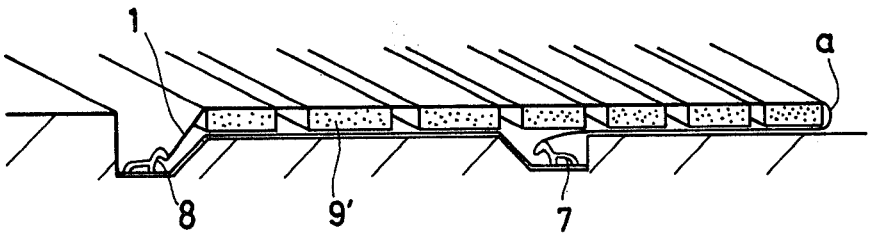

A third embodiment of this invention is shown in FIGS. 5(*a*) and 5(*b*). According to this embodiment, attaching members 9' having non-flexibility such as lead are used. When these attaching member are attached to the inner surface of the envelope 1, these members should have a predetermined width and be equally spaced along the inner surface of envelope 1 in order to avoid deterioration of the curvature of envelope 1 when inflated, and to avoid interference between attaching members. These attaching members 9' can be adhered to either the upstream portion of the envelope from the imaginary folded line "a" or the downstream portion thereof. These attaching members can also be adhered along the whole inner surface of the envelope between the anchors 7 and 8.

Figure 6:
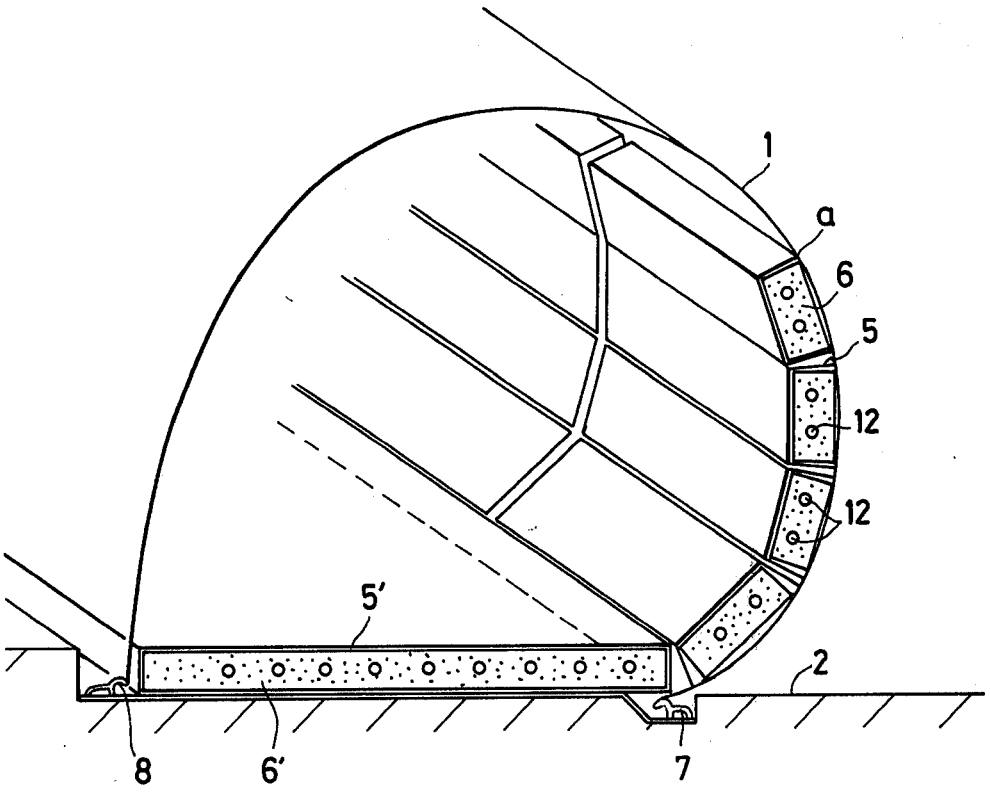

A fourth embodiment of this invention is shown in FIG. 6, wherein a material 12 having large specific gravity is embedded in shock absorbing mats 6,6', positioned in pockets 5,5', in order to obtain a total weight of the dam larger than its buoyancy during the deflating state thereof, to thus avoid floating thereof. Material 12 can comprise, for example, lead rods. Since the lead rods per se do not provide sufficient shock absorbing effect, the diameter of the rods should be small. Further, it is necessary to prevent these rods from being positioned in line along the thickness direction of the shock absorbing mats. Alternatively, the materials having a large specific gravity can be attached to the side faces of the shock absorbing mats 6,6'.

According to FIG. 6, the shock absorbing mat or buffer members 6' are disposed on the whole dam base, and further, a plurality of the shock absorbing mats 6 are positioned along the whole inner peripheral surface of the downstream portion of the envelope 1 from the imaginary folded line "a". However, such positional arrangement may not be limited to this embodiment. For example, instead of employing the plurality of buffer pieces at the inner surface, a single buffer mat can be attached along the downstream portion of the inner surface of the envelope.

In view of the foregoing, according to this invention, total weight of the dam overcomes the buoyancy given by residual fluid or the like during the deflating state thereof, to thus prevent the dam from floating. Therefore, even if water stays at the downstream side of the dam, the envelope can be completly fallen down into the water during its deflates state.

While the invention has been described in detail and with reference to specific embodiments thereof, it will be apparent to one skilled in the art that various changes and modifications can be made therein without departing from the spirit and scope thereof.

What is claimed is:

1. In an inflatable flexible envelope dam for damming a river, including a flexible envelope having an open end fixed to a river bed, said envelope being inflatable with a fluid to form an upstanding dam, and being deflatable so that said envelope falls down upon discharge of said fluid therefrom, whereby following said discharge, a residual amount of said fluid remains in said envelope, the improvement comprising at least one attaching piece attached to said envelope, said attaching piece having a large specific gravity, the combined weight of said envelope, attaching piece, and residual amount of fluid being greater than the weight of said river displaced by said envelope, attaching piece, and fluid.

2. The improvement of claim 1, wherein said attaching piece is attached to an inner surface of said envelope.

3. The improvement of claim 1 or 2, wherein said attaching piece comprises a flexible material so that said attaching piece when combined with said envelope is flexible.

4. The improvement of claim 3, wherein said flexible attaching piece is a rubber having large specific gravity.

5. The improvement of claim 1 or 2, wherein said at least one attaching piece having a large specific gravity is a lead piece.

6. The improvement of claim 1 or 2, wherein said at least one attaching piece is attached to an entire inner surface of said envelope.

7. The improvement of claim 1 wherein said at least one attaching piece is attached to about one-half of an inner surface of said envelope, said one-half of said inner surface being the bottom half of said envelope when said envelope is collapsed and laid flat with said fixed open end of said envelope extending directly downstream of a closed end of said envelope, said closed end being fixed to said river bed.

8. The improvement of claim 1 wherein said at least one attaching piece is attached to about one-half of an inner surface of said envelope, said one-half of said inner surface being the top half of said envelope when said envelope is collapsed and laid flat with said fixed open end of said envelope extending directly downstream of a closed end of said envelope, said closed end being fixed to said river bed.

9. The improvement of claim 1 or 2, wherein a plurality of attaching pieces are attached to said envelope, said attaching pieces having predetermined widths and being equally spaced from each other in order to prevent the curvature of said envelope from being deteriorated and to prevent interference between said pieces.

10. The improvement of claim 1 or 2, wherein said envelope has an inner surface formed with at least one shock absorbing piece.

11. The improvement of claim 10, wherein said shock absorbing piece is attached to about one-half of said inner surface of said envelope, said one-half of said inner surface being the bottom half of said envelope when it is collapsed and laid flat with said fixed open end of said envelope extending directly downstream of a closed end of said envelope, said closed end being fixed to said river bed.

12. The improvement of claim 11, wherein a plurality of said shock absorbing pieces are attached to said bottom half of said envelope on said inner surface thereof, one shock absorbing piece extending from said fixed open end of said envelope to said fixed closed end of said envelope, and a plurality of shock absorbing pieces having predetermined widths and being equally spaced from each other in order to prevent the curvature of said envelope from being deteriorated and to prevent interference between said plurality of shock absorbing pieces.

13. The improvement of claim 10, wherein at least one member having large specific gravity is embedded into said at least one shock absorbing pieces.

* * * * *